US009523185B2

(12) United States Patent
Brunelle et al.

(10) Patent No.: US 9,523,185 B2
(45) Date of Patent: Dec. 20, 2016

(54) PLUMBING FIXTURE AND ACCESSORY EQUIPMENT CONCEALING MODULE

(71) Applicant: Gestion Ultra-Internationale Inc., St-Nicolas (CA)

(72) Inventors: Henry Brunelle, Quebec (CA); Louis Gendreau, Sainte-Marie (CA)

(73) Assignee: GESTION ULTRA INTERNATIONALE INC., St-Nicolas, CA (US)

( * ) Notice: Subject to any disclaimer, the term of this patent is extended or adjusted under 35 U.S.C. 154(b) by 539 days.

(21) Appl. No.: 13/688,565

(22) Filed: Nov. 29, 2012

(65) Prior Publication Data

US 2013/0139907 A1 Jun. 6, 2013

(30) Foreign Application Priority Data

Dec. 2, 2011 (CA) ..... 2760456

(51) Int. Cl.
*E03C 1/042* (2006.01)
*E03C 1/04* (2006.01)

(52) U.S. Cl.
CPC ..... *E03C 1/042* (2013.01); *E03C 1/04* (2013.01); *E03C 1/0407* (2013.01); *Y10T 137/6851* (2015.04)

(58) Field of Classification Search
CPC ..... E03C 1/0401–1/0407; E03C 1/048; E03C 1/055; E03C 1/05; E03C 1/021; A47K 3/1615; A47K 3/161; A61H 2201/102
USPC ..... 4/253, 254, 541.1–541.6, 549, 559, 570, 4/584, 591, 594, 620, 626, 630, 646, 653, 4/670, 676, 678, 695; 312/228, 249.3, 312/283, 290, 293.3, 306, 312, 350; 49/378; 160/205; 52/35; 137/801; 196/121
See application file for complete search history.

(56) References Cited

U.S. PATENT DOCUMENTS 3,084,349 A * 4/1963 Sundblad ..... E03C 1/042 4/676
3,180,697 A * 4/1965 Mulch ..... G03B 21/54 206/456
3,542,446 A * 11/1970 Joyce ..... 312/244
4,325,149 A * 4/1982 Moreland ..... A61H 33/028 4/492
4,575,882 A * 3/1986 Diamond ..... 4/559
(Continued)

OTHER PUBLICATIONS

"Tub Be or Not Tub Be", Natalie Hager Interiors, Oct. 29, 2009. http://nataliehagerinteriors.com/uncategorized/tub-be-or-not-tub-be/.*

(Continued)

*Primary Examiner* — Paul R Durand
*Assistant Examiner* — Nicholas Ros
(74) *Attorney, Agent, or Firm* — Norton Rose Fulbright Canada LLP; Alexandre Daoust

(57) ABSTRACT

A fixture concealing module for a stand-alone bathtub is comprised of an enclosure extending upwardly from a support floor and surrounding plumbing conduits extending through the support floor for the supply of domestic cold and hot water. The enclosure has an access opening for access to an interior thereof. A removable closure member is removably secured to the access opening. At least one faucet control is secured in an upper region of the module and accessible to a bather person positioned in the bathtub. A water channelling element projects from the upper region of the module and is in communication with a faucet outlet conduit secured downstream of a valve controlled by the faucet control to direct a flow of water into the bathtub from a top side of the bathtub.

1 Claim, 3 Drawing Sheets

(56) References Cited

U.S. PATENT DOCUMENTS

| | | | | |
|---|---|---|---|---|
| 4,872,224 | A * | 10/1989 | Grimes | A61H 33/6026 248/215 |
| 5,329,650 | A * | 7/1994 | Zaccai | E03C 1/0408 4/596 |
| 6,661,967 | B2 * | 12/2003 | Levine et al. | 392/395 |
| 7,682,562 | B2 * | 3/2010 | Ciechanowski | A61L 2/202 4/541.1 |
| 2005/0217016 | A1 * | 10/2005 | Ciechanowski | A61K 8/02 4/559 |
| 2006/0018786 | A1 * | 1/2006 | Tolman et al. | 422/5 |
| 2008/0095395 | A1 * | 4/2008 | Pieklik | A61H 33/60 381/387 |
| 2008/0257880 | A1 * | 10/2008 | Brown et al. | 219/618 |
| 2011/0072576 | A1 * | 3/2011 | Brunelle | A47K 3/16 4/592 |

OTHER PUBLICATIONS

"North Central Ranch Aug. 2011", TM Construction, Publications. http://www.tmconstructioninc.com/publications/.*

"Signature Hardware Dalles Freestanding Faucet with Resin Tower", Signature Hardware. http://www.signaturehardware.com/dalles-freestanding-tub-filler-with-resin-faucet-tower.html.*

"Amazon—Dalles Freestanding Tub Faucet Matte Resin Tower Chrome", Amazon retail page, Product listed as first available Aug. 27, 2011. http://www.amazon.com/Dalles-Freestanding-Tub-Faucet-Chrome/dp/B005JH1EZY/ref=sr_1_1?s=hi&ie=UTF8&qid=1426852259&sr=1-1&keywords=dalles+matte+resin+tower+chrome.*

* cited by examiner

PLUMBING FIXTURE AND ACCESSORY EQUIPMENT CONCEALING MODULE

TECHNICAL FIELD

The present invention relates to a fixture concealing module for a stand-alone bathtub.

BACKGROUND OF THE ART

Stand-alone bathtubs are usually supplied water by free-standing plumbing fixtures disposed adjacent the bathtub and comprising essentially of water conduits and valve as well as a faucet whereby to introduce water within the bathtub through a faucet extending thereover. The drain conduit is usually part of this assembly. The faucet control handles are connected to a mixing valve to control the mixture of hot and cold water delivered to the faucet. Because this free-standing plumbing arrangement is visible due to the fact that the bathtub is a free-standing bathtub, not secured against walls, this plumbing hardware and accessories is usually made of solid brass which is usually polished and plated. These plated accessories may have various finishes such as brushed or polished nickel, oil rubbed bronze, antique copper or chrome and these accessories are very costly to produce due to the fact that there are many which form an assembly. Also, safety valves which control the supply of hot and cold water to a mixing valve are usually mounted closely spaced from the floor from which the supply conduits and drain extend. These are also visible and therefore also plated.

Another problem associated with the provision of accessories on stand-alone bathtubs is that it is difficult to equip the bathtub with non-standard accessories such as water pumps or air turbines if the bathtub is a hydro-massaging tub with jets provided in the sidewalls thereof or LED lighting to provide lumino-therapy as all of this equipment is difficult to conceal due to the stand-alone aspect of the bathtub. Therefore, it is difficult to equip such stand-alone bathtubs with a multitude of non-standard accessories wherein large component parts form part of these systems.

SUMMARY OF THE INVENTION

It is a feature of the present invention to provide a fixture concealing module for use with a stand-alone bathtub and which substantially overcomes the above-mentioned disadvantages of the prior art.

Another feature of the present invention is to provide a fixture concealing module for a stand-alone bathtub and which make it possible to use economical plumbing fixtures and which is also capable of concealing a multitude of equipment and accessories to provide the bather person with an eye-pleasing and relaxing environment such as the provision of sound therapy, lumino-therapy, hydro-massaging therapy, aroma therapy and other therapies.

Another feature of the present invention is to provide a fixture concealing module for a stand-alone bathtub which is aesthetically pleasing in design and provides ease of access to plumbing fixtures and accessories associated with a stand-alone bathtub for installation and repair.

Another feature of the present invention is to provide a fixture concealing module for a stand-alone bathtub and which permits the addition of accessories thereto at a future time.

Another feature of the present invention is to provide a fixture concealing module for a stand-alone bathtub and wherein noise generating accessories are concealed within insulated compartments of the module.

Another feature of the present invention is to provide a fixture concealing module for a stand-alone bathtub and wherein the control handles of the faucet and other controls are made easily accessible to a bather person while positioned within the bathtub.

According to the above features, from a broad aspect, the present invention provides a fixture concealing module for a stand-alone bathtub. It is comprised of an enclosure extending upwardly from a support floor and surrounding plumbing conduits extending through the support floor for the supply of domestic cold and hot water. The enclosure has an access opening for access to the interior thereof. A removable closure member is removably secured to the access opening. At least one faucet control is secured in an upper region of the module and accessible to a bather person positioned in the bathtub. A water channelling element projects from the upper region of the module and is in communication with a faucet outlet conduit secured downstream of a valve controlled by the faucet control to direct a flow of water into the bathtub from a top side of the bathtub.

DESCRIPTION OF THE DRAWINGS

A preferred embodiment of the present invention will now be described with reference to the accompanying drawings in which.

DETAILED DESCRIPTION OF THE PREFERRED EMBODIMENTS

Figure 1C:
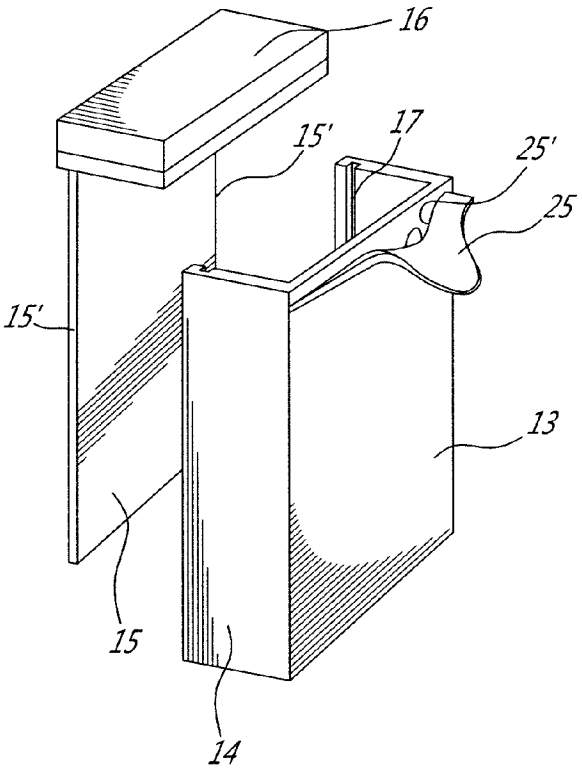
FIG. 1C is a perspective view showing the removable closure member removed from the module.
Figure 2:
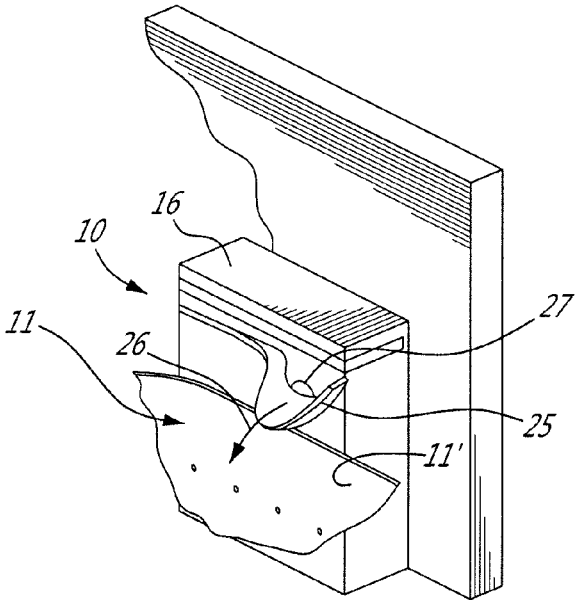
FIG. 2 is a perspective view showing the module installed adjacent a stand-alone bathtub.
Figure 3:
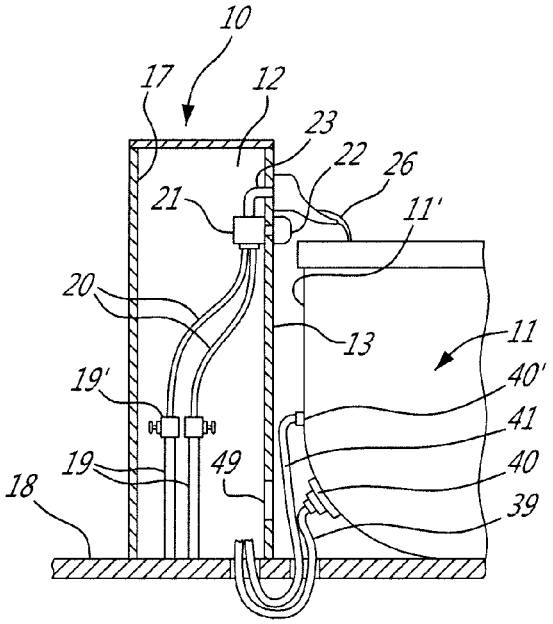
FIG. 3 is a fragmented view showing the free-standing water supply conduit extending at the base of the module and its connection to the mixing valve and its relationship with respect to the bathtub as well as illustrating the supply of air or water conduits to jet channels secured to a side wall of the bathtub as well as supplying electrical conductors to LED lamps through the support floor and from the bottom open end of the module.

Referring now to the drawings, there is shown generally at 10 the fixture concealing module of the present invention for use with a stand-alone bathtub 11, as illustrated in FIGS. 2 and 3. The module comprises an enclosure 12 which can have different shapes and as herein shown it is of substantially rectangular configuration and defines a flat front wall 13, opposed side walls 14 and a rear wall 15. A top wall 16 is secured to the rear wall 15. The rear wall 15 is slidably secured between the opposed side walls 15 with the opposed edges 15' of the rear wall 15 sliding within vertical channels 17 provided adjacent a rear end of the opposed side walls 14, as illustrated in FIG. 1C.

As shown in FIG. 3, the enclosure 12 has an open bottom end and it is secured to the floor 18 adjacent the bathtub 11. The free-standing plumbing supply conduits 19 extend through the floor 18 and are located inside the enclosure 12 as herein shown. To provide access to the free-standing water supply conduits it is merely necessary to remove the rear and top wall assembly as shown in FIG. 10 thereby providing complete access to the inside of the enclosure for the connection of plumbing material and accessories. As herein shown flexible conduits 20 are secured to the free-standing conduits 19 through safety valves 19' to connect hot and cold water to the mixing valve 21 which is controlled by a faucet control knob 22. The outlet conduit 23 of the mixing valve is secured to the front wall 13 in a manner as shown in FIG. 4.

As shown in FIGS. 1A-1C and FIG. 4, a water channelling element 25 herein shaped as a lip having a front projection 25 which exceeds a side wall 11' of the bathtub 11, as shown in FIG. 2 whereby to provide a water supply 26 into the bathtub from the top end thereof, as shown in FIG. 2. An opening 27 is disposed in the trough of the tongue shaped water channelling element 25 to release water therefrom from the outlet conduit 23.

Figure 4:
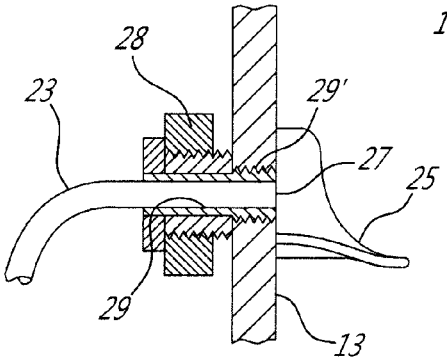
FIG. 4 is a fragmented side view showing an outlet conduit from a mixing valve connected to the front wall of the module and in relationship to a water channelling element secured to the front surface of the front wall.

As shown in FIG. 4 the outlet conduit 23 is provided with a coupling connector 28 which is removably secured in threaded engagement with a threaded male coupling 29 secured in a hole 29' forming the opening 27. Other coupling arrangements are also foreseen and obvious to a person skilled in the art. It is also pointed out that the water channelling element 25 may have various shapes and forms to suit the design of the stand-alone bathtub to which it is intended to be associated with. Accordingly, the water channelling element 25 is removably secured to the front wall 13 by suitable means obvious to a person skilled in the art in a leak-proof manner to prevent water leakage from the opening 27. For example, a bead of silicone or gasket or other sealant material may be affixed between the rear surface 25' of the water channelling element and the surface of the front wall 13.

Figure 1B:
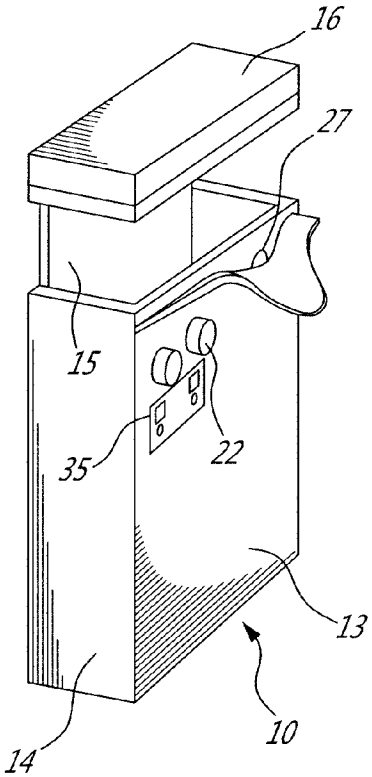
FIG. 1B is a perspective view similar to FIG. 1A showing the module with the removable closure member in a partly disengaged position.
Figure 1A:
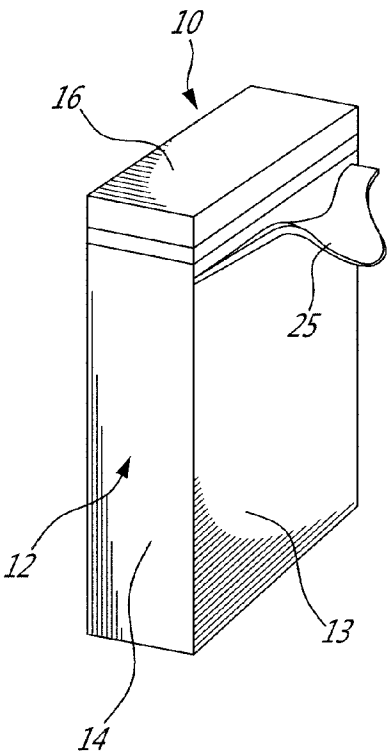
FIG. 1A is a perspective view of the fixture concealing module of the present invention.
Figure 5:
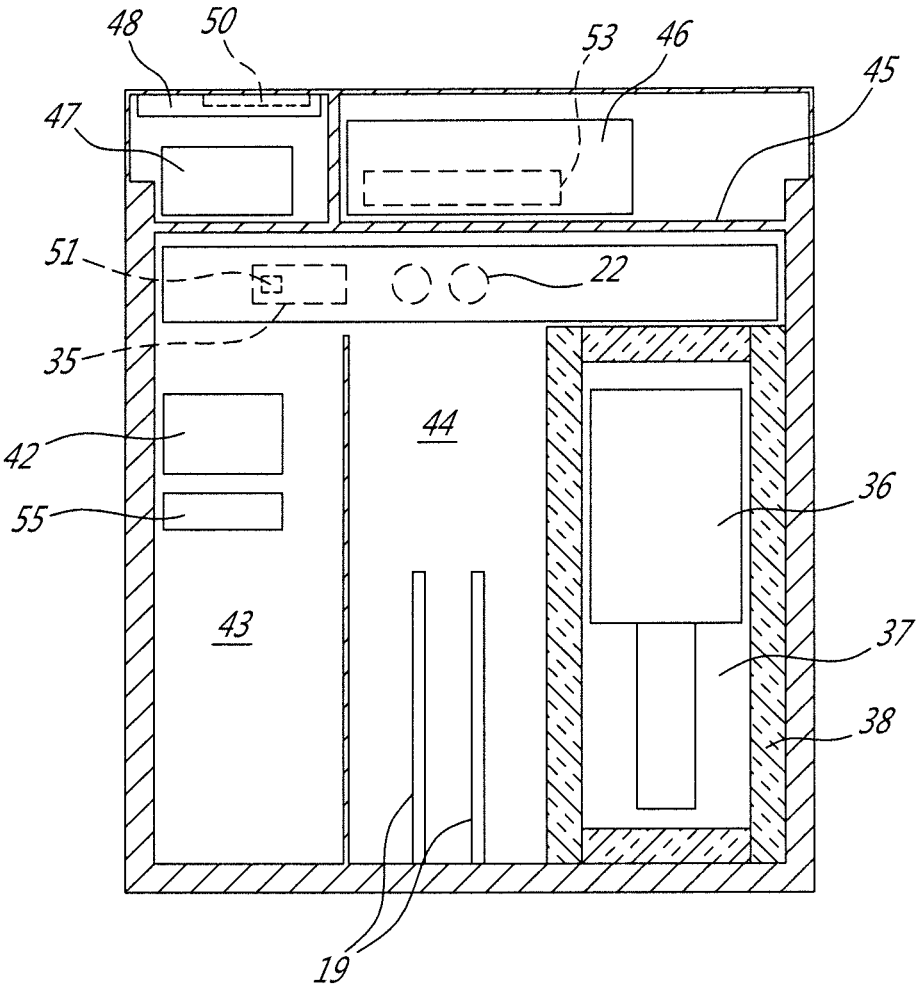
FIG. 5 is a cross-section view showing the compartmented module with various accessories that can be mounted therein.

The stand-alone bathtub 10 may be of a standard type only requiring a supply of water thereto. However, the fixture concealing module 10 of the present invention is adapted for use with different types of stand-alone bathtubs, such as hydro-massaging bathtubs and is dimensioned to conceal various accessories that are associated with such bathtubs other than the water supply lines and faucet handles 22 above described. As shown in FIGS. 1B and 5, a control panel 35 may be provided with various switching means to select programs for operating a turbine 36 secured in an insulated compartment 37 provided with sound insulating material 38 therein. The turbine has an air intake, not shown, in the rear wall 15 of the module and connects to conduits, such as conduits 39 shown in FIG. 3 which are secured to channels 40 in the side wall 11' of the hydro-massaging bathtub to supply air under pressure thereto. The channels 40 are usually concealed by an outer skin of the bathtub. As shown in FIG. 3 the conduits 39 may extend through the floor 18 and into the module 10 whereby to substantially conceal the flexible piping. As also shown in FIG. 3 a series of LED lamps 40' are herein shown having their electrical wiring 41 also extending through the floor 18 and into the module 10 in a concealed manner. The LEDs are provided a DC supply through the electrical supply assembly 42 housed within another compartment 43 and it has a program therein which is operated by the control panel 35. Power is supplied through the floor 18 and into the enclosure 12. The compartments 43 and 37 isolate the plumbing compartment 44 to protect the circuitry and equipment in the compartments from any water damage. If the hydro-massaging tub is provided with water jets then a re-circulating water pump would be mounted in the insulated housing 37 instead of the air turbine 36 and feed the massaging water jets in a similar fashion as illustrated in FIG. 3.

As also shown in FIG. 5, the enclosure 12 may also be provided with supports such as a shelf 45 in a top part thereof to house a sound system 46 or an air ionizer system 47 and an induction plate 48 including all wiring and connections therefor. The shelf 45 would isolate these components from the lower compartments 37, 43 and 44 and are all accessible from the top and rear of the enclosure of the module. The front wall 13 of the module may also be provided with a removable panel 49, see FIG. 3, to connect the conduits 39 and wiring 41 of the hydro-massaging bathtub instead of going through the floor 18.

As shown in FIG. 5, the induction plate 48 has a cavity 50 in a top surface thereof to receive a scented liquid therein. Heating means such as resistive heating elements may be casted within the induction plate 48. A touch-sensitive switch 51 may also be provided in the control panel 35 to actuate the induction plate to heat the liquid to release a relaxing scent to a bather person. The sound system 46 is also provided with a waterproof speaker support grill 53 secured in the front wall 13 of the enclosure in a top part thereof. A junction box 55 is provided for the various electrical supply connections and fuses for the systems housed within the module.

It is within the ambit of the present invention to cover any obvious modifications of the preferred embodiment described herein provided such modifications fall within the scope of the appended claims.

We claim:

1. A fixture concealing module for a stand-alone bathtub, said module comprising an enclosure extending upwardly from a support floor and surrounding plumbing conduits extending through said support floor for the supply of domestic cold and hot water, said enclosure having an access opening for access to an interior thereof, a removable closure member removably secured to said access opening, at least one faucet control secured in an upper region of said module and accessible to a bather person positioned in said bathtub, and a water channelling element projecting from said upper region of said module and in communication with a faucet outlet conduit secured downstream of a valve controlled by said faucet control to direct a flow of water into said bathtub from a top side of said bathtub; wherein said module further houses and conceals an aroma therapy accessory associated with said bathtub, and control means secured to said upper region accessible to a bather person for operation of said aroma therapy accessory; wherein said aroma therapy accessory includes wiring and connections therefore; wherein said enclosure is provided with supports for housing said aroma therapy accessory; and wherein said aroma therapy accessory includes an induction plate provided on a top wall of said enclosure, said induction plate having a cavity in a top surface thereof to receive a scented liquid, and heating means and switch means for heating said induction plate.

* * * * *